US006971219B2

(12) United States Patent
Krämer et al.

(10) Patent No.: US 6,971,219 B2
(45) Date of Patent: Dec. 6, 2005

(54) BEVERAGE BOTTLING PLANT FOR FILLING BOTTLES WITH A LIQUID BEVERAGE FILLING MATERIAL AND A LABELLING STATION FOR LABELLING FILLED BOTTLES AND OTHER CONTAINERS

(75) Inventors: Klaus Krämer, Dortmund (DE); Heinz-Michael Zwilling, Hamm (DE); Thomas Stienen, Unna (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 10/666,931

(22) Filed: Sep. 18, 2003

(65) Prior Publication Data

US 2004/0123955 A1 Jul. 1, 2004

(30) Foreign Application Priority Data

Sep. 20, 2002 (DE) ..... 102 43 704

(51) Int. Cl.[7] ..... B65B 61/00

(52) U.S. Cl. ..... 53/415; 53/136.1; 156/320; 156/322; 156/499; 156/497

(58) Field of Search ..... 53/415, 135.2, 53/136.1; 156/320, 322, 499, 497

(56) References Cited

U.S. PATENT DOCUMENTS

| | | | | |
|---|---|---|---|---|
| 2,524,945 | A * | 10/1950 | Von Hofe | 156/320 |
| 2,525,741 | A * | 10/1950 | Von Hofe et al. | 156/499 |
| 2,621,823 | A * | 12/1952 | Perry | 156/320 |
| 4,079,875 | A * | 3/1978 | Zodrow | 156/521 |
| 4,233,331 | A * | 11/1980 | Lemke et al. | 53/133.3 |
| 4,468,274 | A * | 8/1984 | Adachi | 156/320 |
| 4,605,459 | A * | 8/1986 | Voltmer et al. | 156/322 |
| 4,724,029 | A * | 2/1988 | Kontz | 156/320 |
| 5,021,111 | A * | 6/1991 | Swenson | 156/320 |
| 5,635,004 | A * | 6/1997 | Pazdernik et al. | 156/227 |
| 6,401,787 | B1 * | 6/2002 | Tsutsumi et al. | 156/542 |
| 6,438,927 | B1 * | 8/2002 | Focke et al. | 53/415 |

* cited by examiner

*Primary Examiner*—John Sipos
(74) *Attorney, Agent, or Firm*—Nils H. Ljungman & Associates

(57) ABSTRACT

A beverage bottling plant for filling bottles with a liquid beverage comprising of a filling machine, a bottle closing station and a labeling station configured and disposed to label filled bottles. The labeling station comprises a label storage magazine configured to hold a plurality of single-sheet labels in a stacked condition, pie-shaped grippers, that extract labels from the storage magazine and directly apply them on the bottles. The grippers are heated prior to applying the labels to the bottles to assist in securing the labels and then the grippers are cooled. -

16 Claims, 5 Drawing Sheets

BEVERAGE BOTTLING PLANT FOR FILLING BOTTLES WITH A LIQUID BEVERAGE FILLING MATERIAL AND A LABELLING STATION FOR LABELLING FILLED BOTTLES AND OTHER CONTAINERS

BACKGROUND OF THE INVENTION

1. Field of the Invention

The invention may possibly relate to a beverage bottling plant for filling bottles with a liquid beverage filling material and a labelling station for labelling filled bottles and other containers.

2. Background Information

A bottling plant for filling bottles with a liquid beverage filling material generally may comprise a station to rinse bottles prior to filling, and a station to fill bottles. Filling may comprise a selection of different products that would be filled into corresponding bottles. A bottling plant also generally comprises a station to close bottles, a labelling station or machine to label bottles, and may comprise a containerization station.

With respect to labelling, the state of the art comprises numerous solutions for attaching labels to containers, such as, for example, bottles, cans and the like. Labelling machines or labelling stations that process single-sheet labels comprising paper or plastic foil have experienced a concentration of design and development.

Such labelling machines or stations have been known for a long time. These labelling machines or stations, generally, operate in accordance with the scheme described herein below.

The containers at which labels are to be attached are conveyed to a carousel conveyer that may be driven to rotate about its vertical axis and that has a plurality of rotatable receptors for the containers; conveying being done by known conveyer equipment, such as, for example, belt conveyers, a dividing screw conveyer, and an input starwheel conveyer. Along the path through the labelling machine or station, the container performs one rotational movement, or several rotational movements. Upon the container having completed its passage through the labelling machine or station, the container is generally removed from the labelling machine or station by way of an output starwheel conveyer and by a further belt conveyer.

One or several labelling stations or machines that transfer or apply the labels to the containers that are to be furnished with a label are disposed peripherally with respect to the circle described by the carousel conveyer.

Such known labelling stations, and/or labelling machines, essentially comprise a label storage magazine, a gluing station, a gripper cylinder, and a plurality of gluing segments, the latter being disposed at a further carousel conveyer.

The adhesive or glue that is required for securing the labels to the corresponding containers is made available on a gluing roller that is disposed within the gluing station. The gluing segments perform a rolling motion on the gluing roller and in this manner pick up the necessary quantity of glue or adhesive. Subsequently, the gluing segments perform a rolling motion on the labels that are present in the label storage magazine, with the labels being disposed with their corresponding backsides towards the gluing segment. The adhesive action that is achieved by the glue or adhesive that is disposed on the gluing segments, during the rolling motion of the gluing segments, effectuates that the corresponding first label is taken from the label storage magazine. This first label is wetted with glue or adhesive, and this label is then transported to the gripper cylinder. Within, or at, the gripper cylinder, the label is gripped by grippers, is removed from the gluing segment, and, upon the gripper cylinder performing a further rotating movement, the label is transferred to the container at which a label is to be affixed.

Along the further path of the container through the labelling machine or station, the label is fully adhered to the container in further treatment stations, for example, by channels for blown air, and/or by brush channels.

In efforts to further increase the production rate of such labelling machines or stations, practical experience has demonstrated that the gluing process is one of the essential operational points that may limit the production rate of a labelling machine. The gluing stations that are necessary for performing the gluing process in known equipment essentially comprise a rotating gluing roller, a glue scraper, and a glue or adhesive composition application device. As already discussed herein above, upon deposition of glue or adhesive onto the gluing roller, the gluing roller and gluing segment contact one another in a rolling movement such that glue or adhesive is transferred to the gluing segment.

An increase of the production rate of the entire facility (bottling plant, and/or labelling station, or labelling machine) requires that the peripheral velocity of the gluing roller is increased. However, upon the peripheral velocity exceeding a certain magnitude, separating phenomena of the glue arise that are primarily due to the attendant centrifugal forces and the higher rates of velocity that are experienced during splitting of the glue film between the gluing roller and the gluing segment. Glue drops may separate from the gluing roller and can be flung a considerable distance due to their velocity and can soil portions of the labelling machine or station that are far removed from the gluing station.

Gluing as described herein above entails a drawback that is a function of technology, and, additionally, gluing stations present highly bulky structures and need to be made with a high degree of precision, such endeavors leading to high overall costs.

Furthermore, the gripper cylinders that are necessary for the herein above described processing cause high costs during design, manufacture, and assembly because such gripper cylinders comprise a highly complex structure.

A novel adhesive development in the field of adhesive compositions or, respectively, glues, has made it possible to pursue avenues for the design of labelling machines or stations that process single-sheet labels, which permit elimination of the entire gluing station and, in a particularly advantageous embodiment, also permit elimination of the gripper or gripping cylinder.

Hitherto various adhesive compositions were known that achieved their adhesive strength or their ultimate tenacity, for example, by evaporation of a solvent, for example, water, or upon completion of a chemical reaction, for example, polymerization.

Further known are so-called hot-setting or thermosetting adhesives that are solid at room temperatures and their upper surfaces are adhesive only within limits, or not at all; however, at elevated temperatures they become liquid. Such adhesive compositions are available, for example, as granules, and they are delivered into a collection container that is associated with the labelling machine or station. There the granules are heated to such an extent that they are rendered in liquid form and, accordingly, become available for further processing steps. By way of a pump arrangement, the liquid hot-setting adhesive is passed to the label gluing station and is there transferred to the labels, the gluing station generally being heated. The labels that are furnished with the glue are subsequently adhered to the containers that need to have a label affixed. There the hot-setting adhesive cools and develops its full adhesive capability, such that the label is securely attached to the container.

The recently developed adhesive compositions provide a fundamental change with respect to the previously known adhesive compositions. Upon being heated to a predetermined temperature, or to above a predetermined temperature, in a single heating step, they can be activated.

In the normal condition or, respectively, starting condition, these adhesive compositions do not adhere, and they may be processed like paints, that is, for example, by printing, by spraying, and so forth, such that one can produce any desired configuration with nearly any desired thickness.

Upon drying, these adhesive compositions form a film that adheres to the corresponding backing, but the exposed upper surface is not adhesive.

A single heating of the adhesive composition to above a predetermined temperature will cause that such composition is activated.

This means that the adhesive composition upon a single heating to above the 'control temperature' is rendered to be adhesive, and this property is retained even upon cooling, for example, upon cooling to room temperature.

OBJECT OF THE INVENTION

It is an object of the invention described below to solve the problems encountered on similar devices of the prior art.

It is also an object of the invention to provide a labelling station or machine for processing of single-sheet labels.

It is further an object of the invention to provide a labelling station or machine in which gluing stations and a gripper cylinder are not necessary.

SUMMARY OF THE INVENTION

In one aspect the invention teaches that these objects may be accomplished by a beverage bottling plant for filling bottles with a liquid beverage filling material, said beverage bottling plant comprising: a filling machine configured to fill empty bottles with liquid beverage filling material; said beverage filling machine comprising a plurality of beverage filling positions, each beverage filling position comprising a beverage filling device for filling bottles with liquid beverage filling material; said filling devices comprising apparatus configured to introduce a predetermined flow of liquid beverage filling material into the interior of bottles to a substantially predetermined level of liquid beverage filling material; said apparatus configured to introduce a predetermined flow of liquid beverage filling material comprising apparatus configured to terminate the filling of beverage bottles upon liquid beverage filling material reaching said substantially predetermined level in bottles; a conveyer arrangement configured and disposed to move empty bottles to said filling machine; a closing station configured to close filled bottles; a conveyer arrangement configured and disposed to transfer filled bottles from said filling machine to said closing station; a labelling station configured and disposed to label filled bottles with a label; a conveyer arrangement configured and disposed to transfer closed bottles from said closing station to said labelling station; said labelling station comprising: a conveyer arrangement configured and disposed to move closed bottles within said labelling station; a label storage magazine configured to hold a plurality of single-sheet labels in a stacked condition; apparatus, with label grippers, configured and disposed to extract labels from said label storage magazine and to directly apply an extracted label on a filled, closed bottle to be labelled; apparatus configured and disposed to directly heat a label, prior to applying the label on a filled, closed bottle, thus at least to assist in securing an applied label to a filled, closed bottle; said label grippers being configured and disposed to grip an extracted label and to release a gripped label to thus permit a label to be applied to a filled, closed bottle; apparatus configured and disposed to press and to smooth a label to a bottle; and a conveyer arrangement configured and disposed to remove labelled bottles from said labelling station.

The invention also teaches that these objects may be accomplished by a labelling station for labelling a container, said labelling station comprising: a moving arrangement configured and disposed to move containers by said labelling station; a label storage magazine; apparatus, with at least one label gripper, configured and disposed to extract a label from said label storage magazine and to apply a label on a container to be labelled; and apparatus configured and disposed to directly heat a label, prior to finally securing a label on a container, thus at least to assist in securing a label to a container; said at least one label gripper being configured and disposed to grip a label and to release a gripped label to permit a label to be secured to a container.

The invention further teaches that these objects can be accomplished by a method of operating a labelling station for labelling a container, said labelling station comprising: a moving arrangement configured and disposed to move containers by said labelling station; a label storage magazine; apparatus, with at least one label gripper, configured and disposed to extract a label from said label storage magazine and to apply a label on a container to be labelled; and apparatus configured and disposed to directly heat a label, prior to finally securing a label on a container, thus at least to assist in securing a label to a container; said at least one label gripper being configured and disposed to grip a label and to release a gripped label to permit a label to be secured to a container; said method comprising the steps of: removing a label from said label storage magazine; applying a removed label, with said apparatus configured and disposed to extract a label from said label storage magazine, on a container to be labelled; gripping a label with said at least one label gripper; heating a label with said heating apparatus, prior to finally securing a label on a container, thus at least to assist in securing a label to a container; and releasing a gripped label from said at least one label gripper to thus permit a label to be secured to a container.

Also, the invention in one aspect teaches that single-sheet labels are used that comprise, at least on one side of the label, preferably the backside of the label, and at least in predetermined locations, a layer of the adhesive composition of the type described herein above, and that, further, means are provided within the labelling machine or station that permit a brief heating of the layer of the heat-activatable adhesive composition to a temperature that is greater then the "control temperature", such that the adhesive is made active.

The utilization of single-sheet labels that are provided with a heat-activatable adhesive composition affords substantial advantages. Thus, a number of structural components of the labelling machine or station are not necessary, for example, a gluing station, a gripper cylinder, a glue pump, and a glue supply container. The user of the machine has benefits because soiling by glue is eliminated, as are the costs associated with obtaining, storing, and permanently replenishing glue.

Provision of a layer of a heat-activatable adhesive composition on the backside of labels is expected not to appreciably increase the cost of the labels, because paper labels are nowadays already printed on both sides, for improvement of their characteristics, and because the new adhesive composition, i.e., the heat-activatable adhesive, exhibits processing qualities which allow processing analogous to paint.

Labelling machines or stations for processing of single-sheet labels that have a layer of the new adhesive composition have hitherto not become known.

The invention is further described in detail in the following with reference to embodiments.

The above-discussed embodiments of the present invention will be described further herein below. When the word "invention" is used in this specification, the word "invention" includes "inventions", that is the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the accompanying drawings.

DESCRIPTION OF THE PREFERRED EMBODIMENTS

Figure 1:
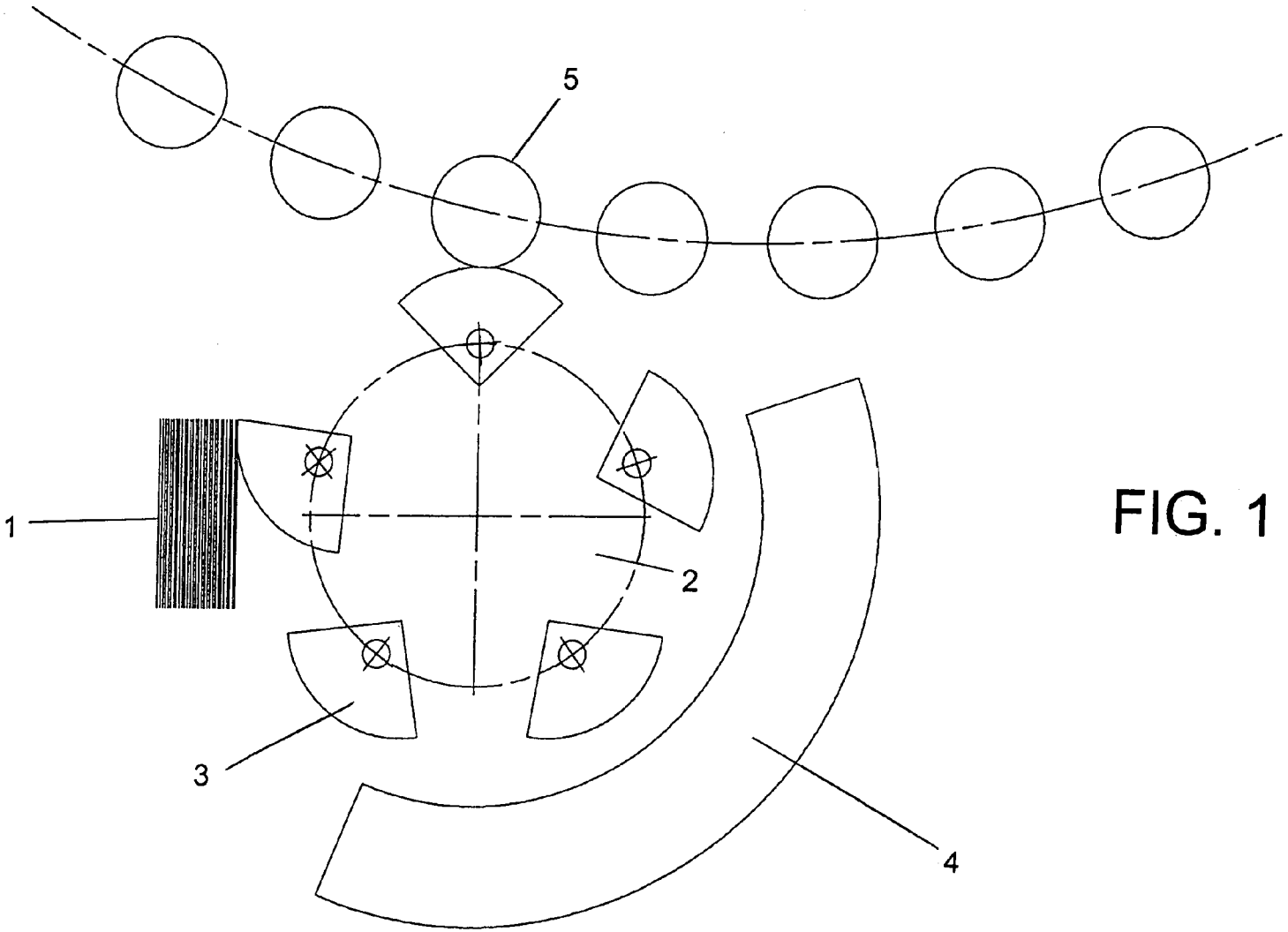
FIG. 1 is a simplified plan view, of a labelling station in accordance with one embodiment of the invention, comprising a labelling station, in which a gripper cylinder is obviated, for performing the label attaching function.
Figure 1A:
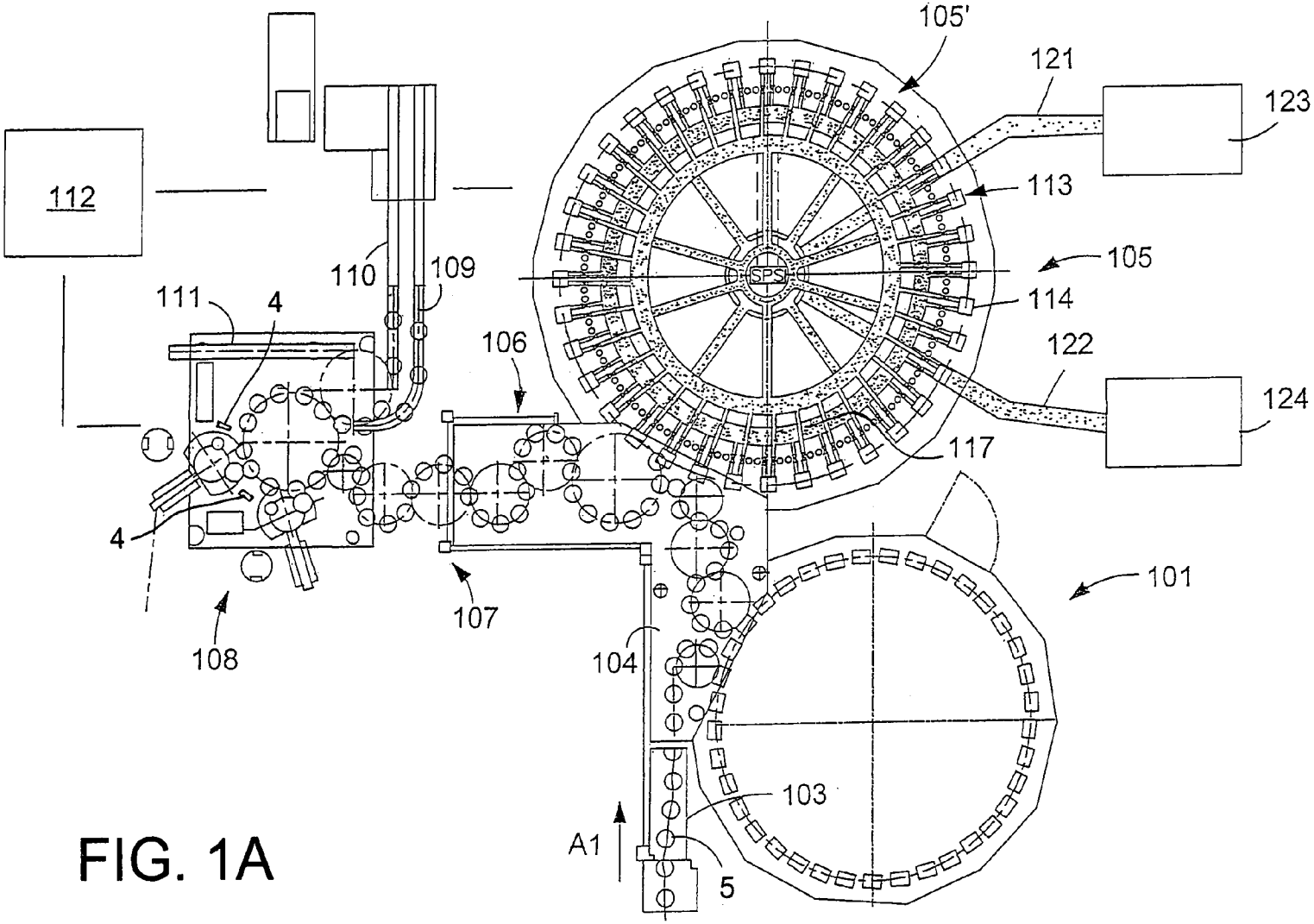
FIG. 1A is a simplified overhead view of a plant for filling, closing and subsequent labelling of containers, such as, bottles, with which the present invention can be utilized.

FIG. 1A illustrates a bottling plant with a rinser 101, to which the containers, namely bottles 5, are fed in the direction indicated by the arrow A1 by means of a conveyer line 103, and downstream of which, in the direction of travel, the rinsed bottles 5 are transported by means of a conveyer line 104 formed by a star-wheel conveyer to a filling machine 105 or its inlet star-wheel conveyer. Downstream of the filling machine 105, in the direction of travel of the bottles 5, there can preferably be a closer 106 which closes the bottles 5. The closer 106 can be connected directly to a labelling device or station 108 by means of a conveyer line 107 formed by a plurality of star-wheel conveyers. In the illustrated embodiment, the labelling device 108 has, for example, two heaters 4 and three outputs. One output is formed by a conveyer 109 for bottles 5 which are filled with a first product from product mixer 123 through conduit 121 and are then labelled corresponding to this product. A second output is formed by a conveyer 110 for those bottles 5 which are filled with a second product from product mixer 124 through conduit 122 and are then labelled corresponding to this product. A third output is formed by a conveyer 111 which removes any bottles 5 which have been incorrectly labelled.

In FIG. 1A, 112 is a central control unit or, expressed differently, controller or system which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers, as well as a filling element 114 located above the corresponding container carrier. The toroidal vessel 117 is a component of the revolving rotor 105'. The toroidal vessel 117 can be connected by means of a rotary coupling and by means of an external connecting line 121 to an external reservoir or mixer 123 to supply the product, that is, product mix from reservoir 123, for example.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection, for example, 121) and to a second toroidal vessel which contains a second product (by means of the second connection, for example, 122). In this case, each filling element 114 can also preferably have, at the connections, two individually-controllable fluid or control valves, so that in each bottle 5 which is delivered at the inlet of the filling machine 105 to a filling position 113, the first product or the second product can be filled by means of an appropriate control of the filling product or fluid valves.

It will be understood that while a two-product assembly is illustrated in FIG. 1A, that the invention is equally applicable to single-product installations, or other commensurate embodiments.

Figure 1B:
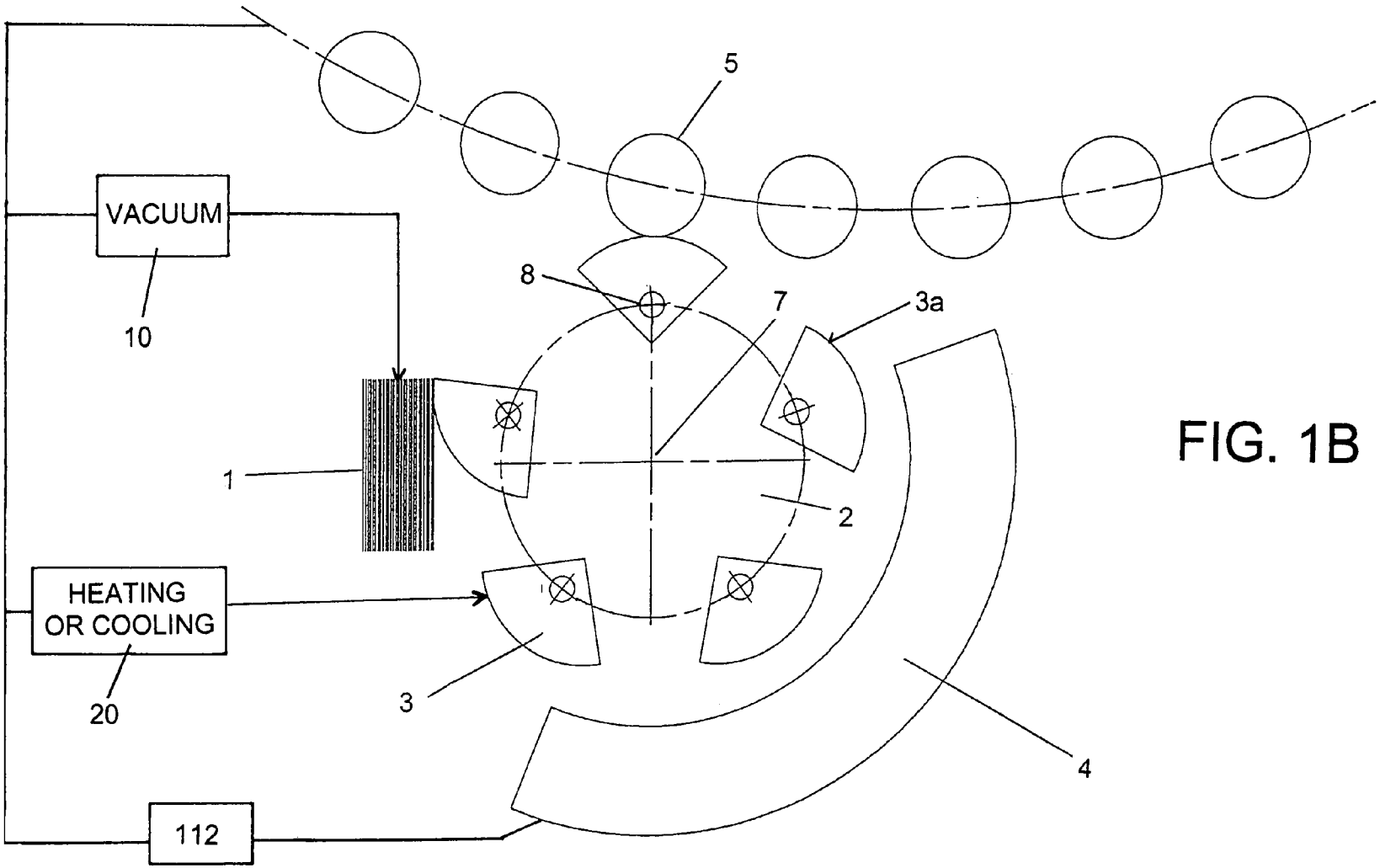
FIG. 1B is a view similar to FIG. 1 and showing additional details.

In the next part, and with reference to FIGS. 1 and 1B, the description is for an embodiment of a labelling machine or station, in accordance with the invention, without a gripper cylinder.

Because the improvements which are part of the present invention in reference to the state of the art are exclusively directed towards the labelling station, further components of a labelling machine or station can be considered to be known prerequisites, and the following description can be limited to the labelling station. Such labelling stations and/or labelling technology are known under the trade names INNOKET, INNOKET KL, which can optionally be equipped with MIS for cold glue processing, INNOKET HL for hot-melt labellers, and INNOKET RF for roll-fed labelers, all of which are owned and manufactured by of KHS Maschinen- und Anlagenbau AG of Dortmund, Germany. Nevertheless, a brief description of a bottling plant and some of the facilities therein is provided herein above.

The labelling station illustrated in FIG. 1 essentially comprises the following components: a label storage magazine 1, a rotatable carousel 2 at which are arranged label grippers 3 and means 4 which heat the heat-activatable adhesive that is present on the backside of the label.

Contrary to present label processing, the labels are deposited in the storage magazine 1 such that their image-bearing side is directed towards the label gripper.

In a modified manner, the label grippers 3 perform the function of the hitherto customary gluing segments in customary labelling machines. While customary gluing segments take labels, due to the adhesive action of the glue or adhesive that is present on the gluing segments, from the label storage magazine 1, this function is realized in the equipment in accordance with one aspect of the present invention thereby that the label grippers 3 grip and remove labels either by means of suitable grippers that operate mechanically, or by means of a generated vacuum. The arrangement of the label grippers 3 is analogous to the arrangement of known gluing segments, that is, the grippers 3 are journalled in such a way that they can rotate about a corresponding vertical axis, and they are disposed at the circumference of a carousel conveyer 2 that is driven for rotation.

Subsequently, the label is moved further along its path by way of a label gripper 3 that is disposed at a carousel conveyer 2.

As is evident from FIG. 1, a label that is held by the label gripper in the described manner, moves in a path that is configured as an arc of a circle from the label storage magazine to the containers to be labelled.

It is within the scope of the invention that at the periphery of this arc of a circle, and/or at other suitable locations, means are arranged which permit heating, for at least a short period of time, of the backside of the label that is coated, at least at predetermined locations, with the glue or adhesive that has been described herein above, to a temperature greater than the activation temperature of the glue or adhesive.

For one, a suitable mode of heating the adhesive-bearing locations of the label backsides comprises a source of heat produced by electrical current. These means may comprise, for example, heat radiators, heating wires, hot-air jets, and so forth.

It is also possible to heat the adhesive-bearing locations by means of at least one laser beam. Provision can be made that the laser beam can be swung by a suitable or corresponding arrangement, such that also large-area, adhesive-bearing locations can be positively heated. Provision can also be made that the laser beam device can be swung, and/or moved, either in its entirety, or at least in part.

In a further embodiment of the present invention, provision can be made to utilize the dielectrical capacity of water that is contained in the adhesive composition, and to heat the adhesive-bearing locations of a label by the effect of microwaves or, respectively, microwave radiation.

It is further possible to heat the adhesive-bearing locations by the effect of a light beam, and/or an infrared beam, and/or an ultraviolet beam. In this, the period of time during which the ray or radiation is effective can be of varying length, such that in the case of a short period of time of such radiation or beam being effective, such radiation or beam may essentially be termed a flash, and in the case of a longer period of time of such radiation or beam being effective, such radiation or beam may be termed radiation or, respectively, lighting. The scope of the present invention includes that light, and/or radiation, or a beam, having a wavelength other than the wavelengths described herein above, can be utilized.

It is also within the scope of the present invention, in accordance with an independent embodiment, that the adhesive-bearing locations are heated by ultrasound waves.

It is also possible to configure the label grippers 3 to be at least temporarily heated. This may be supplemental to, or fully replacing, further heating means for heating of the adhesive bearing areas. Care has to be taken then that the heating effort of the label gripper 3, as to magnitude, point in time, and duration, is controlled such that the adhesive of the next label is not activated during take-up of a preceding label from the label storage magazine 1. For the realization of this function, it is possible that within, and/or outside, of the label gripper 3 a cooling device configured to cool the gripper is present.

For heating, and for cooling, of the label gripper 3 all methods of the prior art are applicable.

For all the equipment variants described herein above it is contemplated that the thermal or other capacities or ratings of the corresponding aggregates are adapted to the labelling capacity or rating of the labelling machine or station, such that a positive heating of the adhesive-bearing locations to above the activation temperature of the adhesive at any present rate of production is ensured within the operating spectrum of the labelling machine or station.

Upon activation of the adhesive that is present on the labels having been effectuated, the labels are further moved by the label gripper 3, and they are finally respectively transferred to the corresponding container 5 that is to be labelled. This may entail that the label grippers 3, for transfer of the label to the container 5, carry out an additional radial movement in the direction of the container 5, that is, they perform a so-called output control.

The labelling station illustrated in FIG. 1B also essentially comprises the following components: a label storage magazine 1, a rotatable carousel 2 at which are arranged label grippers 3 with grippers 3*a* and means 4 which heat the heat-activatable adhesive that is present on the backside of the label. The carousel 2 may be driven by a drive 7 and the label grippers 3 may be driven by a cam drive arrangement 8. A vacuum may be applied by apparatus 10. It will be appreciated that heating and/or cooling of label grippers 3 and grippers 3*a* can be carried out by an apparatus identified by reference numeral 20. The operation of the labelling station is subject to the central control unit 112, that is, the central control unit 112 controls operation of the various elements that form part of the labelling station, possibly under direction of pre-set parameters of operation for the plant.

Figure 2:
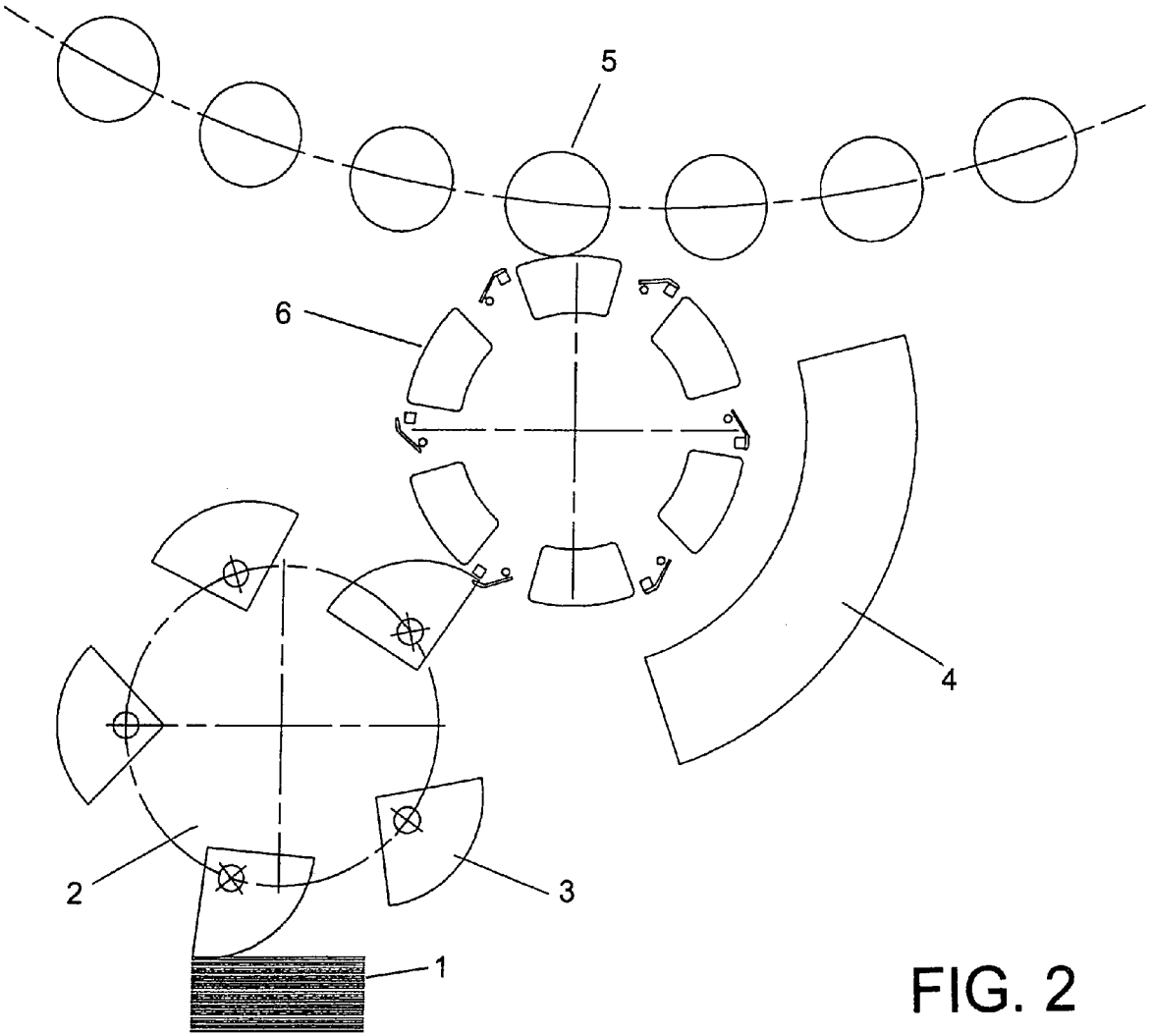
FIG. 2 is a simplified plan view, of a labelling machine or station with a label attaching station that comprises a gripper cylinder arrangement in accordance with one embodiment of the present invention.
Figure 2A:
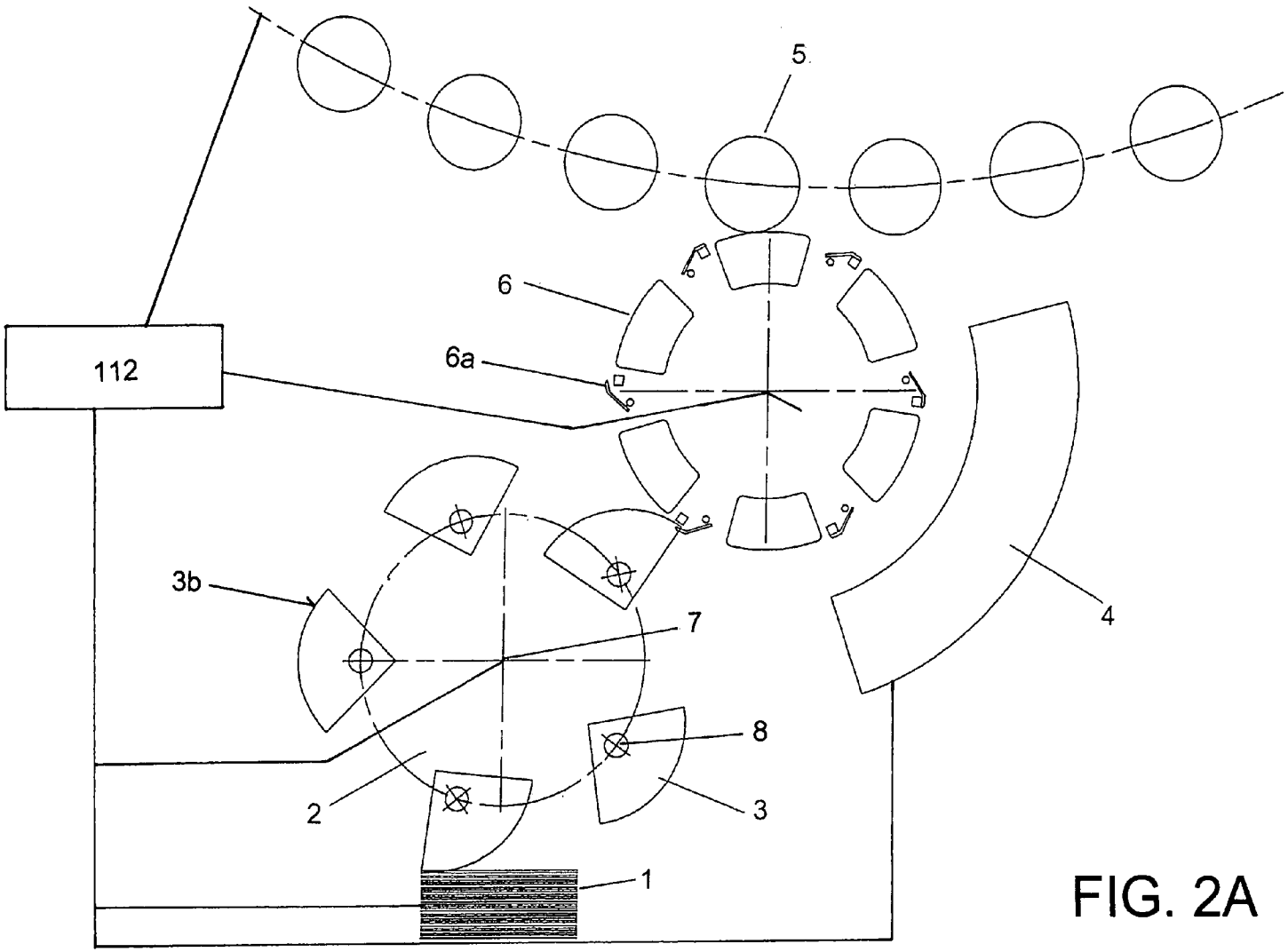
FIG. 2A is a view similar to FIG. 2 and showing additional details.

In a further independent embodiment of the present invention, a gripper or gripping cylinder or drum 6 may find utilization. A corresponding labelling machine is illustrated in FIG. 2 and FIG. 2A.

The operation of this embodiment is as follows.

The labels are positioned in the label storage magazine 1 in such a way that the respective backside is directed towards the label grippers 3. By way of a vacuum produced, or by the action of mechanical grippers, a label gripper 3 removes a label from the label storage magazine 1. Upon completion of a rotary or turning movement, the label is removed by the gripper cylinder 6 from the label gripper 3, and the label is moved further. While the label is held by the gripper cylinder 6, the backside of the label that is coated with adhesive is presented outwardly, such that the backside of the label is accessible for further treatment. By reason of the movements of the gripper cylinder 6, the label describes an arc of a circle. Again, for this embodiment it is contemplated that at the periphery of the arc of a circle, and/or at further suitable locations, there are arranged means 4 which permit heating at least for a short period of time of the adhesive to above the activating temperature.

With reference to the means 4 as such and the control of their capacity, reference may be had to the embodiments described with reference to the first embodiment. It is contemplated that the first described embodiment variants are also applicable in this second embodiment.

The labelling station illustrated in FIG. 2A essentially comprises the following components: a label storage magazine 1, a first rotatable carousel 2 at which are arranged label grippers 3 with grippers 3*b* and means 4 which heat the heat-activatable adhesive that is present on the backside of the label. The carousel 2 may be driven by a drive 7 and the label grippers 3 may be driven by a cam drive arrangement 8. A second carousel structure comprises a gripper or gripping cylinder 6 driven by a drive 9. The gripper cylinder 6 has grippers 6*a*. It will be appreciated that heating and/or cooling of grippers 6*a* can be carried out by a suitable apparatus. The operation of the labelling station is subject to the central control unit 112, that is, the central control unit 112 controls operation of the various elements that form part of the labelling station, possibly under direction of pre-set parameters of operation for the plant.

One feature of the invention resides broadly in the labelling machine for processing single-sheet labels that have a layer of heat-activatable adhesive, characterized thereby that the labels are taken from a label storage magazine 1 by label grippers 3 and are subsequently directly passed by the label grippers 3, and/or further elements, alongside of means 4 that are configured to activate the adhesive, and the labels are then transferred to the containers 5.

Another feature of the invention resides broadly in the labelling machine characterized thereby that the further elements comprise gripper cylinders 6.

Yet another feature of the invention resides broadly in the labelling machine characterized thereby that the means 4 are disposed at the circularly arcuate path that is described by the circumference of label grippers 3, and/or by the gripper cylinder 6 or gripper cylinders 6.

Still another feature of the invention resides broadly in the labelling machine characterized thereby that means 4 are provided that heat the heat-activatable adhesive by way of transfer of energy to a temperature greater than the activating temperature and that thereby activate the adhesive.

A further embodiment of the invention resides broadly in the labelling machine characterized thereby that the means 4 comprise heat radiators, and/or heating wires, and/or heated air blowers.

Another feature of the invention resides broadly in the labelling machine characterized thereby that the means 4 comprise devices that heat the heat-activatable adhesive by way of a light beam, and/or by way of an infrared beam, and/or by way of an ultraviolet beam.

Yet another feature of the invention resides broadly in the labelling machine characterized thereby that the means 4 comprise devices that heat the heat-activatable adhesive by way of the action of microwaves.

Still another feature of the invention resides broadly in the labelling machine characterized thereby that the means 4 comprise devices that heat the heat-activatable adhesive by way of the action of laser beams.

A further feature of the invention resides broadly in the labelling machine characterized thereby that the means 4 comprise devices that heat the heat-activatable adhesive by way of the action of ultrasound.

Another feature of the invention resides broadly in the labelling machine characterized thereby that label grippers 3 are provided that are configured to take labels from the label storage magazine 1 by way of production of a vacuum.

Yet another feature of the invention resides broadly in the labelling machine characterized thereby that label grippers 3 are provided that are configured to take the labels from the label storage magazine 1 by way of mechanically actuated grippers.

Still another feature of the invention resides broadly in the labelling machine characterized thereby that the operating rate of the arranged means 4 may be adapted to the operating rate of the labelling machine A further feature of the invention resides broadly in the labelling machine characterized thereby that the label grippers 3 may be heated and/or cooled.

The components disclosed in the various publications, disclosed or incorporated by reference herein, may be used in the embodiments of the present invention, as well as equivalents thereof.

In accordance with one aspect of the present invention, there is now provided a labelling machine or station for processing single-sheet labels each having a layer of a heat-activatable adhesive, and there is disclosed that activating means are provided that heat the adhesive to a temperature that is greater than the temperature at which the adhesive may be made active, to thereby activate the adhesive.

Some examples of bottling systems, which may be used or adapted for use in at least one possible embodiment of the present invention, may be found in the following U.S. patents assigned to the assignee herein, namely: U.S. Pat. No. 4,911,285; U.S. Pat. No. 4,944,830; No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The appended drawings in their entirety, including all dimensions, proportions and/or shapes in at least one embodiment of the invention, are accurate and are hereby included by reference into this specification.

Some additional examples of container filling systems, valves or methods and their components which may be incorporated in an embodiment of the present invention may be found in the following U.S. patent. U.S. Pat. No. 5,458,166; U.S. Pat. No. 5,566,695; U.S. Pat. No. 5,689,932; U.S. Pat. No. 5,732,528; U.S. Pat. No. 5,778,633; and U.S. Pat. No. 6,058,985.

All, or substantially all, of the components and methods of the various embodiments may be used with at least one embodiment or all of the embodiments, if more than one embodiment is described herein.

Some examples of methods and apparatuses for closing bottles and containers and their components which may possibly be used or adapted for use in at least one possible embodiment of the present invention may be found in the following U.S. patents: U.S. Pat. No. 5,398,485; U.S. Pat. No. 5,402,623; U.S. Pat. No. 5,419,094; U.S. Pat. No. 5,425,402; U.S. Pat. No. 5,447,246; and U.S. Pat. No. 5,449,080.

Some examples of rotary position sensors and rotary position indicators, components thereof, and components associated therewith, which may be utilized in accordance with the embodiments of the present invention, may be found in the following U.S. patents: U.S. Pat. No. 5,396,139; U.S. Pat. No. 5,419,195; U.S. Pat. No. 5,424,632; U.S. Pat. No. 5,433,118; U.S. Pat. No. 5,442,329; and U.S. Pat. No. 5,444,368.

All of the patents, patent applications and publications recited herein, and the references cited therein, and recited in the Declaration attached hereto, are hereby incorporated by reference as if set forth in their entirety herein.

Some examples of filling machines that utilize electronic control devices to control various portions of a filling or bottling process and which may possibly be utilized in connection with the present invention may be found in the following U.S. patents: U.S. Pat. No. 4,821,921; U.S. Pat. No. 5,056,511; U.S. Pat. No. 5,273,082; and U.S. Pat. No. 5,301,488.

The corresponding foreign patent publication applications, namely, Federal Republic of Germany Patent Application No. 102 43 704.1, filed on Sep. 20, 2002, having inventors Klaus KRÄMER, Heinz-Michael ZWILLING, and Thomas STIENEN, and DE-OS 102 43 704, having inventors Klaus KRÄMER, Heinz-Michael ZWILLING, and Thomas STIENEN, and DE-PS 102 43 704, having inventors Klaus KRÄMER, Heinz-Michael ZWILLING, and Thomas STIENEN, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of microcomputer control systems which may possibly be incorporated in an embodiment of the present invention may be found in the following U.S. patents: U.S. Pat. No. 5,530,515; U.S. Pat. No. 5,548,774; U.S. Pat. No. 5,581,771; U.S. Pat. No. 5,610,749; U.S. Pat. No. 5,619,669; U.S. Pat. No. 5,664,199; and U.S. Pat. No. 5,687,345.

The details in the patents, patent applications and publications may be considered to be incorporable, at applicant's option, into the claims during prosecution as further limitations in the claims to patentably distinguish any amended claims from any applied prior art.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, the abstract is not intended to limit the claims in any manner and should not be interpreted as limiting the claims in any manner.

U.S. patent application Ser. No. 10/653,617, filed on Sep. 2, 2003, having inventors Klaus Krämer and Lutz DECKERT, and Attorney Docket No. NHL-HOL-60, and entitled, "Vorrichtung für Sleeve-Etikettiermaschinen," and claiming priority from Federal Republic of Germany Patent Application No. DE P 102 40 520.3, filed on Sep. 3, 2002, as well as published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Some examples of sheet feeder arrangements, features of which may possibly be used or adapted for use in at least one embodiment of the present invention may be found in the following U.S. patents: U.S. Pat. No. 3,942,787 and U.S. Pat. No. 4,522,388.

Some examples of gripper devices, features of which may possibly be used or adapted for use in at least one possible embodiment of the present invention may be found in the following U.S. patent. U.S. Pat. No. 3,934,589; U.S. Pat. No. 5,265,868; U.S. Pat. No. 4,415,392; U.S. Pat. No. 5,527,027; U.S. Pat. No. 5,727,601; and U.S. Pat. No. 6,039,375.

Some examples of the control of various gripper systems, features of which may possibly be used or adapted for use in at least one embodiment of the present invention may be found in the following U.S. patents: U.S. Pat. No. 3,929,069; U.S. Pat. No. 4,003,310; U.S. Pat. No. 4,031,824; U.S. Pat. No. 4,147,105; U.S. Pat. No. 4,582,316; and U.S. Pat. No. 4,905,595.

Some examples of labels that may possibly be used with a possible embodiment of the present invention may be found in the following U.S. patents: U.S. Pat. No. 5,905,099; U.S. Pat. No. 6,391,415; and U.S. Pat. No. 6,391,415.

Some examples of arrangements that supply heat energy, features of which may possibly be used or adapted for use in at least one possible embodiment of the present invention may be found in the following U.S. patents: U.S. Pat. No. 5,192,853; U.S. Pat. No. 5,814,909; U.S. Pat. No. 5,990,600; U.S. Pat. No. 6,294,758; and U.S. Pat. No. 6,439,298. Particularly, some examples of heating wires may be found in the following U.S. patents: U.S. Pat. No. 4,531,049; U.S. Pat. No. 4,575,620; U.S. Pat. No. 4,742,212; U.S. Pat. No. 5,013,268; U.S. Pat. No. 5,384,448; and U.S. Pat. No. 6,573,484. Some examples of heaters that supply a flow hot air may be found in the following U.S. patents: U.S. Pat. No. 3,820,551; U.S. Pat. No. 4,013,083; U.S. Pat. No. 4,644,606; U.S. Pat. No. 4,979,316; U.S. Pat. No. 5,195,164; and No. 5,251,281. Some examples of heaters may be found in the following U.S. Pat. No. 6,512,210; No. 6,563,094; No. 6,563,096; No. 6,568,792; No. 6,614,004; and No. 6,614,008. Some examples of heaters that supply a light beam may be found in the following U.S. Pat. No. 5,018,808; No. 6,215,579; No. 6,278,542; No. 6,297,487; No. 6,359,847; and No. 6,559,875. Some examples of heaters that supply an infrared heat radiation may be found in the following U.S. Pat. No. 5,058,196; No. 5,278,938; No. 5,910,267; No. 6,190,162; and No. 6,612,835. Some examples of heaters that supply an ultraviolet heat radiation may be found in the following U.S. Pat. No. 4,504,445; No. 5,230,792; No. 5,324,423; No. 5,536,400; No. 5,387,400; and No. 5,814,523. Some examples of apparatus configured to supply heat by way of microwaves may be found in the following U.S. Pat. No. 5,064,494; No. 5,188,256; No. 5,512,734; No.

5,798,395; No. 5,804,801; and No. 5,879,756. Some examples of apparatus configured to supply laser beam radiation may be found in the following U.S. Pat. No. 5,948,291; No. 5,978,404; No. 6,240,111; No. 6,380,511; No. 6,493,148; and No. 6,543,907. Some examples of apparatus configured to produce ultrasound may be found in the following U.S. Pat. No. 3,242,029; No. 6,063,220; No. 6,217,686; No. 6,527,759; No. 6,575,906; and No. 6,613,005. Some examples of heaters that supply electromagnetic waves may be found in the following U.S. Pat. No. 5,123,989; No. 5,628,859; No. 5,985,083; No. 6,007,663; No. 6,436,532; and No. 6,600,142.

It will be understood that the examples of patents, published patent applications, and other documents which are included in this application and which are referred to in paragraphs which state "Some examples of . . . which may possibly be used in at least one possible embodiment of the present invention . . . " may possibly not be used or useable in any one or more embodiment of the invention.

The sentence immediately above relates to patents, published patent applications and other documents either incorporated by reference or not incorporated by reference.

Some examples of vacuum sheet-feeder arrangements, features of which may possibly be used or adapted for use in at least one possible embodiment of the present invention may be found in the following U.S. patents: U.S. Pat. No. 4,336,929; U.S. Pat. No. 4,579,330; U.S. Pat. No. 5,076,565; U.S. Pat. No. 5,232,213; and U.S. Pat. No. 6,189,883; U.S. Pat. No. 6,607,193. All of the foregoing U.S. patents are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A beverage bottling plant for filling bottles with a liquid beverage filling material, said beverage bottling plant comprising:

a filling machine configured to fill empty bottles with liquid beverage filling material;

said beverage filling machine comprising a plurality of beverage filling positions, each beverage filling position comprising a beverage filling device for filling bottles with liquid beverage filling material;

said filling devices comprising apparatus configured to introduce a predetermined flow of liquid beverage filling material into the interior of bottles to a substantially predetermined level of liquid beverage filling material;

said apparatus configured to introduce a predetermined flow of liquid beverage filling material comprising apparatus configured to terminate the filling of beverage bottles upon liquid beverage filling material reaching said substantially predetermined level in bottles;

a conveyer arrangement configured and disposed to move empty bottles to said filling machine;

a closing station configured to close filled bottles;

a conveyer arrangement configured and disposed to transfer filled bottles from said filling machine to said closing station;

a labeling station configured and disposed to label filled bottles with a label;

a conveyer arrangement configured and disposed to transfer closed bottles from said closing station to said labeling station;

said labeling station comprising:

a conveyer arrangement configured and disposed to move closed bottles within said labeling station;

said conveyer arrangement comprising a starwheel having symmetrically-shaped starwheel pockets being disposed on the periphery of said starwheel and being configured to receive bottles to be labeled;

a label storage magazine configured to hold a plurality of single-sheet labels in a stacked condition;

a label extracting and applying apparatus, with label grippers, configured and disposed to extract labels from said label storage magazine and to directly apply an extracted label on a filled, closed bottle to be labeled disposed in a starwheel pocket of said starwheel;

a heating apparatus configured and disposed to directly heat an extracted label, prior to finally applying the label on a filled, closed bottle, thus at least to assist in securing an applied label to a filled, closed bottle;

each of said label grippers being substantially in the shape of a pie piece and having a curved circular outer surface being substantially less than a complete circle; and each of said pie-piece-shaped label grippers being configured and disposed to grip an extracted label on said outer surface of said label grippers and to release a gripped label to thus permit a label to be applied to a filled, closed bottle; and a conveyer arrangement configured and disposed to remove labeled bottles from said labeling station;

further comprising all of (A), (B), (C), (D), (E), (F) and (G) wherein (A), (B), (C), (D), (E), (F), and G) comprise:

(A) said heating apparatus to heat a label comprises one of (I), (II), (III), (IV), and (V), wherein (I), (II), (III), (IV), and (V) comprise:

(I) at least one of: a heat radiator, a heating wire, and a heated-air blower, (II) at least one of: an arrangement configured to produce a light beam, an arrangement configured to produce an infrared beam, and an arrangement configured to produce an ultraviolet beam, (III) an arrangement to produce microwaves, (IV) an arrangement to produce a laser beam, and (V) an arrangement to produce ultrasound waves;

(B) said label grippers comprise mechanically actuatable label grippers;

(C) control apparatus for controlling operation of said labeling station;

(D) each of said label grippers is configured and disposed to produce a vacuum to permit removal of a label from said label storage magazine and gripping of the label;

(E) said label extracting and applying apparatus comprises:

a first structure;

a second structure, said label grippers are mounted on said first structure, said second structure is configured to receive extracted labels from said label grippers on said first structure to permit the labels to be secured to bottles;

said first structure has a central longitudinal axis;

said first structure is configured to rotate about said central longitudinal axis in a substantially circular path;

said second structure has a central longitudinal axis;

said second structure is configured to rotate about said central longitudinal axis of said second structure in a substantially circular path; and said heating apparatus is disposed adjacent at least one of: said substantially circular path of said first structure, and said substantially circular path of said second structure, to permit heating of a label having a composition on a backside thereof;

(F) an arrangement within said grippers configured and disposed to heat said label grippers; and an arrangement within said grippers configured and disposed to cool said label grippers; and (G) said curved circular outer surface of each of said pie-piece-shaped label grippers being about one quarter of a circle.

2. The bottling plant according to claim 1, comprising at least one of: (A), (B), (C), (D), (E), (F), and (G), wherein (A), (B), (C), (D), (E), (F), and (G) comprise:

(A) said heating apparatus to heat a label comprises one of (I), (II), (III), (IV), and (V), wherein (I), (II), (III), (IV), and (V) comprise:

(I) at least one of: a heat radiator, a heating wire, and a heated-air blower, (II) at least one of: an arrangement configured to produce a light beam, an arrangement configured to produce an infrared beam, and an arrangement configured to produce an ultraviolet beam, (III) an arrangement to produce microwaves, (IV) an arrangement to produce a laser beam, and (V) an arrangement to produce ultrasound waves;

(B) said label grippers comprise mechanically actuatable label grippers;

(C) control apparatus for controlling operation of said labeling station;

(D) each of said label grippers is configured and disposed to produce a vacuum to permit removal of a label from said label storage magazine and gripping of the label;

(E) said label extracting and applying apparatus comprises:

a first structure;

a second structure;

said label grippers are mounted on said first structure;

said second structure is configured to receive extracted labels from said label grippers on said first structure to permit the labels to be secured to bottles;

said first structure has a central longitudinal axis;

said first structure is configured to rotate about said central longitudinal axis in a substantially circular path;

said second structure has a central longitudinal axis;

said second structure is configured to rotate about said central longitudinal axis of said second structure in a substantially circular path; and said heating apparatus is disposed adjacent at least one of: said substantially circular path of said first structure, and said substantially circular path of said second structure, to permit heating of a label having a composition on a backside thereof;

(F) an arrangement configured and disposed to heat said label grippers; and an arrangement configured and disposed to cool said label grippers; and (G) said curved circular outer surface of each of said pie-piece-shaped label grippers being about one quarter of a circle.

3. A labeling station for labeling a container, said labeling station comprising:

a moving arrangement configured and disposed to move containers in said labeling station;

a label storage magazine;

a label extracting and applying apparatus, with at least one label gripper, configured and disposed to extract a label from said label storage magazine and to apply a label on a container to be labeled;

a heating arrangement configured and disposed to heat an extracted label, prior to finally securing a label on a container, thus at least to assist in securing a label to a container; and said at least one label gripper being substantially in the shape of a pie piece and being configured and disposed to grip a label and to release a gripped label to permit a label to be secured to a container;

said heating arrangement comprises a heating apparatus configured and disposed to directly heat a label;

an arrangement within said grippers configured and disposed to heat said at least one label;

an arrangement within said grippers configured and disposed to cool said at least one label gripper.

4. The labeling station according to claim 3, wherein:

each of said pie-piece-shaped label grippers has a curved circular outer surface being substantially less than a complete circle; and each of said label grippers is configured and disposed to grip a label on said outer surface of said label grippers.

5. The labeling station according to claim 4, wherein said curved circular outer surface of each of said pie-piece-shaped label grippers is about one quarter of a circle.

6. The labeling station according to claim 5, wherein said heating arrangement comprises at least one of (i) and (ii), wherein (i) and (ii) comprise:

(i) a heating apparatus configured and disposed to directly heat a label; and (ii) an arrangement configured and disposed to heat said at least one label gripper to thus heat a label; and an arrangement configured and disposed to cool said at least one label gripper.

7. The labeling station according to claim 6, wherein said moving arrangement comprises a starwheel having symmetrically-shaped starwheel pockets being disposed on the periphery of said starwheel and being configured to receive containers to be labeled.

8. The labeling station according to claim 7, wherein:

said label storage magazine is configured and disposed to store labels having a substance on a backside thereof to permit a label to be secured to a container; and said heating apparatus comprises one of (I), (II), (III), (IV), and (V), wherein (I), (II), (III), (IV), and (V) comprise:

(I) at least one of: a heat radiator, a heating wire, and a heated-air blower, (II) at least one of: an arrangement configured to produce a light beam, an arrangement configured to produce an infrared beam, and an arrangement configured to produce an ultraviolet beam, (III) an arrangement to produce microwaves, (IV) an arrangement to produce a laser beam, and (V) an arrangement to produce ultrasound waves.

9. The labeling station according to claim 8, wherein: one of (A) and (B):

(A) said at least one label gripper comprises a mechanically actuatable label gripper; and (B) said at least one label gripper is configured and disposed to produce a vacuum to permit removal of a label from said label storage magazine and gripping of the label; and said label extracting and applying apparatus comprises:

a first structure;

a second structure;

said at least one label gripper is mounted on said first structure; and said second structure is configured to receive extracted labels from said label grippers on said first structure to permit the labels to be secured to bottles;

said first structure has a central longitudinal axis;

said first structure is configured to rotate about said central longitudinal axis in a substantially circular path;

said second structure has a central longitudinal axis;

said second structure is configured to rotate about said central longitudinal axis of said second structure in a substantially circular path;

said heating apparatus is disposed adjacent at least one of: said substantially circular path of said first structure, and said substantially circular path of said second structure, to permit heating of a label having an adhesive on a backside thereof; and the labeling station comprises control apparatus for controlling operation of said labeling station.

10. A method of operating a labeling station for labeling a container, said labeling station comprising: a moving arrangement configured and disposed to move containers by said labeling station; a label storage magazine; a label extracting and applying apparatus, with at least one label gripper, configured and disposed to extract a label from said label storage magazine and to apply a label on a container to be labeled; a heating arrangement configured and disposed to heat an extracted label, prior to finally securing a label on a container, thus at least to assist in securing a label to a container; and said at least one label gripper being substantially in the shape of a pie piece and being configured and disposed to grip a label and to release a gripped label to permit a label to be secured to a container, said method comprising the steps of:

removing a label from said label storage magazine with said label extracting and applying apparatus;

gripping a label with said at least one pie-piece-shaped label gripper;

heating a label with said heating arrangement, prior to finally securing a label on a container, thus at least to assist in securing a label to a container;

releasing a gripped label from said at least one pie-piece-shaped label gripper to thus permit a label to be applied to a container; and applying a heated label on a container;

said heating arrangement comprises:

a heating apparatus configured and disposed to directly heat a label;

an arrangement within said grippers configured and disposed to heat said at least one label gripper to thus heat a label and the heat-activatable adhesive thereon; and an arrangement within said grippers configured and disposed to cool said at least one label gripper;

said step of heating a label with said heating arrangement comprises the steps of:

heating said at least one label gripper to thus heat a label and the heat-activatable adhesive thereon;

directly heating the heat-activatable adhesive with said heating apparatus to further heat the heat-activatable adhesive; and cooling with said cooling arrangement said at least one label gripper upon said at least one label gripper being heated and after release of a label being gripped by said at least one label gripper.

11. The method of operating a labeling station according to claim 10, wherein said at least one pie-piece-shaped label gripper has a curved circular outer surface being substantially less than a complete circle; and said at least one label gripper is configured and disposed to grip a label on said outer surface of said at least one label gripper; and wherein said step of gripping a label comprises gripping a label on said outer surface of said at least one label gripper.

12. The method of operating a labeling station according to claim 11, wherein said curved circular outer surface of said at least one pie-piece-shaped label gripper is about one quarter of a circle.

13. The method of operating a labeling station according to claim 12, wherein said label storage magazine is configured and disposed to store labels having a heat-activatable adhesive on a backside thereof to permit a label to be secured to a container, said method comprising the steps of:

storing labels having a heat-activatable adhesive on a backside thereof in said label storage magazine;

said step of removing a label from said label storage magazine comprises removing a label having a heat-activatable adhesive on a backside thereof;

said step of gripping a label with said at least one label gripper comprises gripping a label having a heat-activatable adhesive on a backside thereof;

said step of heating a label with said heating arrangement, prior to finally securing a label on a container, thus at least to assist in securing a label to a container, comprises heating a label having a heat-activatable adhesive on a backside thereof;

said step of releasing a gripped label from said at least one label gripper to thus permit a label to be secured to a container, comprises releasing a label having a heat-activatable adhesive on a backside thereof; and said step of applying a heated label comprises applying a label having a heated adhesive on a backside thereof on a container to be labeled.

14. The method of operating a labeling station according to claim 10, wherein said moving arrangement comprises a starwheel having symmetrically-shaped starwheel pockets being disposed on the periphery of said starwheel and being configured to receive bottles to be labeled.

15. The method of operating a labeling station according to claim 14, wherein said heating apparatus comprises one of (I), (II), (III), (IV), and (V), wherein (I), (II), (III), (IV), and (V) comprise:

(I) at least one of: a heat radiator, a heating wire, and a heated-air blower, (II) at least one of: an arrangement configured to produce a light beam, an arrangement configured to produce an infrared beam, and an arrangement configured to produce an ultraviolet beam, (III) an arrangement to produce microwaves, (IV) an arrangement to produce a laser beam, and (V) an arrangement to produce ultrasound waves.

16. The method of operating a labeling station according to claim 15, wherein one of (A) and (B):

(A) said at least one label gripper comprises a mechanically actuatable label gripper to permit removal of a label from said label storage magazine and gripping of the label; and (B) said at least one label gripper is configured and disposed to produce a vacuum to permit removal of a label from said label storage magazine and gripping of the label;

said step of removing a label from said storage magazine comprises removing a label by generating a vacuum sufficient to remove a label from said label storage magazine; and said step of gripping a label comprises maintaining the vacuum to grip the label;

said label extracting and applying apparatus comprises:

a first structure;

a second structure;

said at least one label gripper is mounted on said first structure;

said second structure is configured to receive extracted labels from said label grippers on said first structure to permit the labels to be secured to bottles;

said first structure has a central longitudinal axis;

said first structure is configured to rotate about said central longitudinal axis in a substantially circular path;

said second structure has a central longitudinal axis; and said second structure is configured to rotate about said central longitudinal axis of said second structure in a substantially circular path;

said heating apparatus is disposed adjacent at least one of: said substantially circular path of said first structure, and said substantially circular path of said second structure, to permit heating of a label having an adhesive on a backside thereof;

said labeling station comprises control apparatus for controlling operation of said labeling station; and said method further comprises the step of controlling with said control apparatus operation of said labeling station, including said heating arrangement.

* * * * *